United States Patent [19]

Fritzman

[11] Patent Number: 4,715,605

[45] Date of Patent: Dec. 29, 1987

[54] TWO AND THREE-DIMENSIONAL NUMBER GAME OR PUZZLE

[76] Inventor: Steven F. Fritzman, 38 Mourning Dove Dr., Stafford, Va. 22554

[21] Appl. No.: 828,478

[22] Filed: Feb. 12, 1986

[51] Int. Cl.[4] ..... A63F 9/06; A63F 9/20

[52] U.S. Cl. ..... 273/156; 273/292; 273/294

[58] Field of Search ..... 273/156, 157 R, 292, 273/294

[56] References Cited

U.S. PATENT DOCUMENTS

| | | | |
|---|---|---|---|
| 487,063 | 11/1892 | Bailey | 273/156 |
| 490,689 | 1/1893 | Thurston | 273/156 |
| 1,121,697 | 12/1914 | Weil | 273/156 |
| 1,450,874 | 4/1923 | Stromee | 273/292 |
| 3,759,526 | 9/1973 | Estvan | 273/294 |
| 3,788,645 | 1/1974 | Nelson | 273/294 X |
| 4,361,328 | 11/1982 | Stein et al. | 273/156 |
| 4,410,180 | 10/1983 | Clark | 273/156 |

FOREIGN PATENT DOCUMENTS

| | | | |
|---|---|---|---|
| 412726 | 7/1934 | United Kingdom | 273/294 |

*Primary Examiner*—Anton O. Oechsle

*Attorney, Agent, or Firm*—Schwartz & Weinrieb

[57] ABSTRACT

A game or puzzle may comprise a two-dimensional embodiment (10) defined by four square-shaped playing cards or puzzle pieces (12), or a three-dimensional embodiment (110) defined by four cubes (112). Indicia is located at each corner (16) of each playing card or piece (12), as well as at a central region (18) of each peripheral edge of the card or piece (12), while similar indicia is located at each corner (116) of each face of each cube (112), as well as at a central region (120) of each cube face. When the cards (12) or cubes (112) are disposed in their proper positions and orientations with respect to each other, predetermined requirements are satisfied between various sets of the indicia indicating that an end to the game, or a solution to the puzzle, has been reached. In order to serve as proofs of solutions, and thereby insure that a true solution has in fact been reached, other sets of indicia will likewise be required to satisfy predetermined relationship requirements. Within the first embodiment (10) of the invention, both sides of each card (12) has indicia thereon, and the indicia may comprise letters, numbers, colors, geometrical configurations, and the like.

14 Claims, 2 Drawing Figures

TWO AND THREE-DIMENSIONAL NUMBER GAME OR PUZZLE

TECHNICAL FIELD

The present invention relates generally to game or puzzle type amusement devices, other than jig-saw type puzzles, and more particularly to a two-dimensional game or puzzle type amusement device comprising four game or puzzle cards, or a three-dimensional game or puzzle type amusement device comprising four game or puzzle cubes, wherein the cards or cubes have various different number dot patterns incorporated thereon at various different locations thereof such that when the cards or cubes are disposed in any one of a number of correct arrangements or orientations relative to each other, the number dot patterns satisfy or meet predetermined rule or array requirements.

BACKGROUND ART

Game or puzzle type amusement devices, other than jigsaw type puzzles, wherein a multitude of pieces interact, or are otherwise mutually arranged, with each other such that particular indicia provided upon the pieces are disposed within a particular or predetermined pattern, array, design, or the like, are of course well known. The provision of the particular indicia upon the game or puzzle pieces, and the arrangement of the pieces with respect to each other, is such, however, that only one combination or arrangement of the game or puzzle pieces, with respect to an extensive number of possible specific orientations or arrangements of the game or puzzle pieces, relative to one another defines the desired solution. This fact that such conventional game or puzzle type amusement devices only have one mode of solution often leads to a marked decline in the popularity of such game or puzzle type amusement devices for the obvious reason that once the player discovers the sole solution to the game or puzzle, or more particularly, once the player has solved the game or puzzle several times, the novelty of the game or puzzle is considerably diminished with the result that the player no longer has a strong interest in, or attraction to, the game or puzzle.

Accordingly, it is an object of the present invention to provide a new and improved game or puzzle type amusement device.

Another object of the present invention is to provide a new and improved game or puzzle type amusement device which is unique and novel.

Still another object of the present invention is to provide a new and improved game or puzzle type amusement device which, as a result of its novelty and uniqueness, overcomes the disadvantages of conventional game or puzzle type amusement devices.

Yet another object of the present invention is to provide a new and improved game or puzzle type amusement device wherein the pieces thereof may be arranged within more than one predetermined array or mode so as to attain any one of a number of predetermined solutions to the game or puzzle whereby the game or puzzle is susceptible of being played a multitude of different times with different objectives or goals to be obtained or achieved such that the play-value and interest by the players with respect to the game or puzzle is considerably enhanced.

Still yet another object of the present invention is to provide a new and improved game or puzzle type amusement device which is relatively simple in its structure and inexpensive to manufacture.

Yet still another object of the present invention is to provide a new and improved game or puzzle type amusement device which requires one to exercise his or her mental facilities in, for example, the performance of addition and subtraction exercises, in order to attain the goals or objectives of the game or puzzle.

A further object of the present invention is to provide a new and improved game or puzzle type amusement device which will serve as a source of continuous attraction and amusement, and ultimately pleasure, as the player orients the game or puzzle pieces so as to arrange the same in various relative permutations and combinations in order to achieve the objectives or goals of the game or puzzle.

DISCLOSURE OF THE INVENTION

The foregoing and other objectives of the present invention are achieved through the provision of a first two-dimensional embodiment of a game or puzzle type amusement device which comprises a set of four cards, each of which has the configuration of a square. Each square is provided with a dot pattern, with the number of dots varying from zero to nine, at each corner of the square as well as at the central position of each edge of the square. In addition, both sides of each square card is provided with such indicia.

In playing the game or solving the puzzle involving the first embodiment of the present invention, the four square cards are arranged in a two-by-two array so as to form an overall square, and when the cards are disposed within this array, the dotted indicia are, in turn, disposed at particular positions or locations which are designated in accordance with a nomenclature system characteristic of the present invention whereby the game or puzzle may be played or solved according to predetermined rules, requirements, or relationships. For example, the four numbered dot indicia at the center of the overall square are designated the target numbers; the four numbered dot indicia located at the external corners of the overall square are designated the ring numbers; the eight numbered dot indicia located at the central peripheral edge regions of the overall square are designated the outside target line numbers; the eight numbered dot indicia located upon the peripheral edge portions of the overall square, but at the center of each edge of each individual square card, are designated the outside center numbers; and the remaining eight numbered dot indicia located within the central regions of the overall square between the outside target line numbers and the target numbers are designated the inside target line numbers.

In accordance with predetermined modes of playing the game involving the first embodiment of the present invention, or the first embodiment of the present invention puzzle, a first game or puzzle solution can comprise, for example, the fact that the sums of each pair of outside target line numbers and the corresponding pairs of inside target line numbers equal the sums of the four target numbers. Alternatively, as another example of a particular mode of playing the game or solving the puzzle of the first embodiment of the present invention, the sum of the four target numbers and a pair of outside target line numbers will be required to equal the sum of the pair of inside target line numbers corresponding to the particular pair of outside target line numbers. Still further, the different numbers can be arranged in particular groups of numbers and particular play or puzzle patterns established between the various groups. For example, games or puzzles can be played wherein a first group comprises all of the outside target line numbers, while a second group comprises all of the inside target line numbers, and a third group comprises all of the target numbers. According to a first mode of playing the game or solving the puzzle, it may be pre-established that the sums of all of the numbers within each group must be equal, or alternatively, that the sums of the numbers within groups one and two are equal, but are not equal to the sum of the numbers within group three. Alternatively, further, the sums of the numbers within groups one and three are equal, but are not equal to the sum of the numbers within group two, or still further, that the sums of the numbers within groups two and three are equal, but the sum of the numbers within group one is different, or lastly, for example, the sums of the numbers within each of the groups is different from the sums of the numbers within the other two groups. Remembering that both sides of each square card are provided with the numbered dot indicia, when one complete side of the squares as arranged in the two-by-two array is in fact disposed within an array such that one of the aforenoted exemplary games or puzzles is achieved, in accordance with the rules of the present invention game or puzzle, the other or flip side of the entire square, comprising the four square cards, must also satisfy one of the aforenoted exemplary puzzles or games. This is known as the proof of solution. If the reverse or flip side of the entire square does not in fact satisfy one of the aforenoted exemplary puzzle or game modes, then a true solution to the game, or resolution of the puzzle, has not been found. Alternatively, other proofs of solution may be established, such as, for example, both sets of target numbers upon the two sides of the entire square must equal a predetermined number, such as, for example, twenty-one, or in lieu of utilizing the target numbers, a similar proof of solution can be established with the two sets of ring numbers, the two sets of outside target line numbers, the two sets of inside target line numbers, or both sets of outside center numbers.

A second three-dimensional embodiment of a game or puzzle type amusement device developed in accordance with the principles of the present invention is seen to comprise a set of four blocks, each of which has the configuration of a cube. Each cube is provided with a dot pattern, with the number of dots varying from zero to nine, at each corner of each cube face, as well as at the center of each cube face.

In playing the game or solving the puzzle utilizing the three-dimensional cubes of the second embodiment of the present invention, the four cubes are arranged in a two-by-two array so as to form an overall rectangular parallelepiped, and when the cubes are disposed in this array, the dotted indicia are, in turn, disposed at particular positions or locations which are designated in accordance with a nomenclature system, similar to that used in connection with the first embodiment of the present, whereby the game or puzzle of the second embodiment of the present invention may likewise be played or solved according to predetermined rules, requirements, or relationships. For example, the four numbered dot indicia located at the center of the upper or lower horizontal surface or face of the overall parallelepiped are designated the target numbers; the four numbered dot indicia located at the corners of either the upper or lower horizontal surface or face of the overall parallelepiped are designated the ring numbers; the eight numbered dot indicia located at the central peripheral edge regions upon the upper horizontal surface or face of the overall parallelepiped are designated the top proof numbers; the eight numbered dot indicia located at the upper central regions of the four vertical rectangular surfaces of the parallelepiped are designated the upper vertical proof numbers; the eight numbered dot indicia located at the lower central regions of the four vertical rectangular surfaces of the parallelepiped are designated the lower vertical proof numbers; the eight numbered dot indicia located at the upper corners upon the four vertical rectangular surfaces of the parallelepiped are designated the upper corner numbers; the eight numbered dot indicia located at the lower corners upon the four vertical rectangular surfaces of the parallelepiped are designated the lower corner numbers; and the twenty-four numbered dot indicia located at the center of each cube face are designated the circle numbers.

In accordance with predetermined modes of playing the game involving the second emodiment of the present invention, or the second embodiments of the present invention puzzle, a first game or puzzle solution can comprise, for example, the fact that when the cubes are arranged in a predetermined two-by-two array, the sum of the circle numbers upon each of the four vertically disposed rectangular surfaces of the parallelepiped equal a predetermined amount or number, such as, for example, seven, while at the same time, the sum of the four circle numbers upon the upper or top surface of the parallelepiped equals another predetermined amount or number, such as, for example, eleven. This is known as the seven-eleven game or puzzle.

Alternatively, in accordance with a second, different game or puzzle, the cubes forming the rectangular parallelepiped may be arranged within a two-by-two array such that the two circle numbers upon each of the four vertically disposed rectangular surfaces of the parallelepiped are the same, or match each other, while at the same time, each of the four circle numbers disposed upon the upper or top surface of the parallelepiped are the same or match each other. As a further variation of this particular type or mode of game or puzzles, the cubes can be arranged in a two-by-two array such that the circle numbers upon each of the cube faces comprising the vertically disposed rectangular surfaces of the parallelepiped do not match each other, or are different, while at the same time, the four circle numbers of the four cubes which are disposed within the horizontally disposed upper or top surface of the parallelepiped likewise do not match each other or are different from each other. These two variations of the game or puzzle are known, respectively, as the same-side match game or puzzle, and the same-side mis-match game or puzzle.

As was the case with the two-dimensional first embodiment of the present invention, a proof of solution is provided for within the three-dimensional second embodiment of the present invention. For example, when all of the cubes are properly arranged within any one of the previously described game or puzzle modes, any of the paired top proof numbers will equal a sum which will be the same as the sum of all of the other paired top proof numbers, while at the same time any one of the paired upper vertical proof numbers will equal a sum or total which is the same as the sum or total of all of the other paired upper vertical proof numbers, and similarly with respect to the lower vertical proof numbers. Alternatively, the proof of solution may comprise the fact that each of the top proof numbers of a pair of top proof numbers will be equal to its paired top proof number, while at the same time each one of the upper vertical proof numbers of a pair of upper vertical proof numbers will be equal to its paired upper vertical proof number, and similarly with respect to the lower vertical proof numbers.

BRIEF DESCRIPTION OF THE DRAWINGS

Various other objects, features, and attendant advantages of the present invention will be more fully appreciated as the same becomes better understood from the following detailed description when considered in connection with the accompanying drawings, in which like reference characters designate like or corresponding parts throughout the different views, and wherein.

BEST MODE FOR CARRYING OUT THE INVENTION

Figure 1:
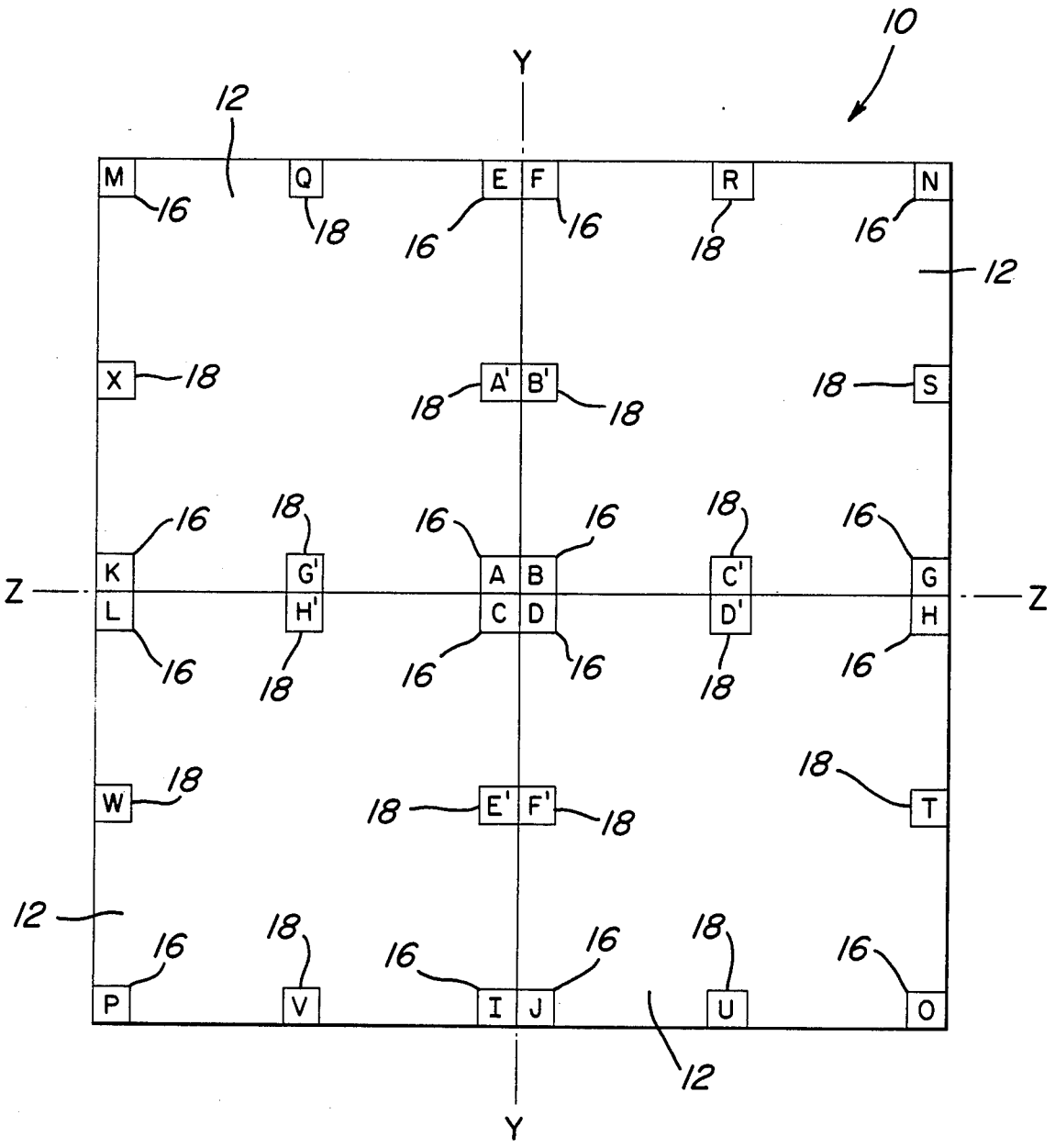
FIG. 1 is a plan view of a first embodiment of the new and improved game or puzzle type amusement device constructed in accordance with the present invention and showing the cooperative parts thereof wherein the square-shaped playing cards are arranged within a two-by-two array so as to form an overall square within which the square-shaped playing cards are oriented with respect to each other, and the reverse sides thereof, so as to satisfy predetermined requirements, relationships, or the like, between the numbered dot indicia provided upon the square-shaped cards at the variously denoted locations thereof.

Referring now to the drawings, and more particularly, initially to FIG. 1 thereof, there is shown a first embodiment of the new and improved game or puzzle type amusement device of the present invention, as generally designated by the reference character 10. As can readily be seen, the new and improved game or puzzle type amusement device constructed in accordance with the first embodiment of the present invention is seen to comprise a set of four square-shaped game playing cards or puzzle pieces 12 which are adapted to be, in effect, mated together and oriented with respect to each other within a two-by-two array, that is, two cards wide and two cards high, so as to form an overall square 14. When the individual game cards or puzzle pieces 12 are in fact arranged within the aforenoted two-by-two array, it is further seen that the cards or game pieces 12 meet or mate with each other along a pair of mutually perpendicular junctions, much like the conventional vertical and horizontal axes of a mathematical graph, which are designated the target lines YY and ZZ.

It is seen that each of the square-shaped playing cards, game pieces, or puzzle components 12 is provided with various indicia upon both faces or surfaces thereof at various locations thereof, as will be more fully described hereinbelow, but at this juncture it is to be emphasized that the indicia comprises dot patterns of a predetermined number of dots at each location, as is conventionally known, for example, in the well-appreciated game of dominoes. The number of dots at any particular location upon each of the game cards or puzzle pieces 12 may vary, for example, between zero and nine. More particularly, it is readily appreciated that the various dot patterns are provided at each of the corners 16 of each game card or puzzle piece 12, as well as at a central peripheral edge region 18 of each game card or puzzle piece 12.

When the game is played, or the puzzle is attempted to be solved, according to particular rules, restrictions, requirements, or the like, as will be more fully set forth hereinbelow, the four game cards or puzzle pieces 12 are mated or joined together along the target lines YY and ZZ by means of various orientations performed in connection with each of the cards or pieces 12 so as to in fact satisfy the aforenoted games rules, requirements, restrictions, or the like, whereby, in fact, a solution to the puzzle, or achievement of the game objective, may be accomplished. In particular, it is readily appreciated, for example, that each of the game cards or puzzle pieces 12 may be rotated in a clockwise or counter-clockwise direction so as to bring a particular edge portion thereof into mating or contact engagement with an edge portion of an adjacent game card or puzzle piece, or alternatively, a particular game card or puzzle piece 12 may be inverted or turned over whereby each of the four edges of such game card or puzzle piece 12, with its different numbered indicia at the corners 16 and central peripheral edge regions 18 thereof, may be aligned or mated with the edge portions of adjacent game cards or puzzle pieces 12 in order to solve the puzzle or win the game.

It is to be further appreciated that when the four game cards or puzzle pieces 12 are in fact disposed within the aforenoted two-by-two array so as to form the overall square 14, some of the numbered indicia locations effectively become altered, and therefore, in order to further the understanding of the present invention, such indicia must be able to be readily identified in an alternative manner. Along these lines, therefore, all of the indicia locations will now be re-identified with respect to the relative positions of the indicia as viewed within the overall array of square 14, and the locations will be designated by means of alphabetic letters, and not numbers, so as not to be confused with the original position designations of the numbered indicia upon each individual game card or puzzle piece.

In particular, the four numbered indicia appearing at the center of the entire overall square array 14 are denoted as the target numbers and are represented by the letter designations ABCD. The eight numbered dot indicia located at the central peripheral edge regions of the overall square 14 are known as the outside target line numbers and are designated by the letters EFGHIJKL, while the eight numbered dot indicia located at central regions of the overall square 14, along the target lines YY and ZZ between the target numbers ABCD and the outside target line numbers EFGHIJKL, are known as the inside target line numbers and are designated by the letters A'B'C'D'E'F'G'H'. Continuing further, the four numbered dot indicia located at the corners of the overall square 14 are known as the ring numbers and have been designated by the letters MNOP, while the remaining eight numbered dot indicia located upon the peripheral edge portions of the overall square 14, but at the center of each exterior edge of each individual square card or piece 12, are known as the outside center numbers and have been designated by the letters QRSTUV WX. As has been alluded to hereinabove, it is to of course also be appreciated that the reverse or other sides of each game card or puzzle piece 12 are likewise provided with the numbered indicia at each of the aforenoted locations such that the respective indicia of any particular game card or puzzle piece 12 may be disposed at the appropriately designated locations during the performance or playing of a game or puzzle resolution depending upon the particular orientation of the game card or puzzle piece 12 in accordance with the various permutations and combinations available to the player. For example, while the particular dot indicia located upon the upper face or surface of the overall square 14, and within the ring number designated location O, may be retained in such position in an initial attempt to win the game or solve the puzzle, the game card or puzzle piece 12 upon which that indicia appears may be moved to the upper left position and rotated counterclockwise 90° such that the indicia at the former ring number location O now occupies the position of, and becomes, an outside target line number at designated location E.

In accordance with the playing rules of the game or puzzle of this first embodiment of the present invention, various predetermined modes of play or puzzle resolution are possible whereby when play is initiated, one of the predetermined modes of play or puzzle resolution must first be agreed upon. For example, a first desired resolution of the puzzle or play of the game may be such that the square game cards or puzzle pieces 12 are to be arranged relative to each other in the formation of overall square 14 such that the sum of a particular pair of outside target line numbers, and the sum of the corresponding pair of inside target line numbers, when added together so as to form a composite total or sum, must be equal to the sum of the four target numbers. In particular, the sum of the dotted indicia at outside target line locations G and H, when added to the sum of the dotted indicia at the corresponding inside target line locations C' and D' must equal the sum of the target number dotted indicia ABCD, which, in turn, will likewise equal the sums of the dotted indicia at the outside and inside target line location pairs of EF and A'B', and IJ and E'F', as well as KL and G'H'.

Alternatively, it may be decided upon that in accordance with a desired solution to the puzzle or game, the sums of the target numbers and a particular pair of outside target line numbers will have to equal the sum of the corresponding pair of inside target line numbers. In other words, the sums of the target numbers ABCD, when added to a pair of outside target line numbers, for example, EF, must equal the sum of the corresponding inside target line numbers A'B', while similarly, the sums of the target numbers ABCD and the outside target line numbers GH or IJ or KL, must equal the sums of the respective inside target like numbers C'D' or E'F' or G'H'.

Still further, in accordance with an additional mode playing the game or requiring solution of the puzzle, the outside target line numbers EFGHIJKL may be designated a first group, all of the inside target line numbers A'B'C'D'E'F'G'H' may be designated a second group, and the target numbers ABCD may be designated a third group. According to predetermined or agreed-upon rules of the game or puzzle, therefore, the game or puzzle is considered to be won or resolved if either the sums of the numbers of the three groups are all equal to each other, or the sum of the numbers of groups one and two are equal to each other but different from the sum of the numbers of group three, or the sum of the numbers of groups one and three are equal to each other but different from the sum of the numbers of group two, or the sum of the numbers of groups two and three are equal to each other but different from the sum of the numbers of group one, or the sums of the numbers of all three groups are different from each other.

When the square cards or game pieces 12 are in fact disposed within an array which satisfies a predetermined one of the aforenoted relationships between the different number groups or series of the invention, in order to verify the fact that one of the predetermined relationships has actually been established, the reverse sides of the square cards or games pieces 12 will also be disposed within an array wherein one of the aforenoted relationships will likewise have been established. This is known as the proof of solution and it is to be emphasized that only when both sides of the overall square 14, as comprised by the individual square cards or pieces 12, satisfies one of the aforenoted relationships, then the game has been won or the puzzle has been solved. As an alternative type of a proof of solution, the two sets of target numbers ABCD, upon both sides of the overal square 14, can each have a predetermined total or sum, or alternatively, each one of both sets of the ring numbers MNOP upon both sides of the overall square 14 can have a total or sum equal to a predetermined or predesignated number. In a similar manner, each set of the outside target line numbers EFGHIJKL, or each set of the inside target line numbers A'B'C'D'E'F'G'H', or each set of the outside center numbers QRSTUVWX, can have a predetermined sum or total equal to each other, or still yet further, all of such sets of target numbers, ring numbers, outside target line numbers, inside target line numbers, and outside center numbers must equal a predetermined or pre-designated sum total number.

Figure 2:
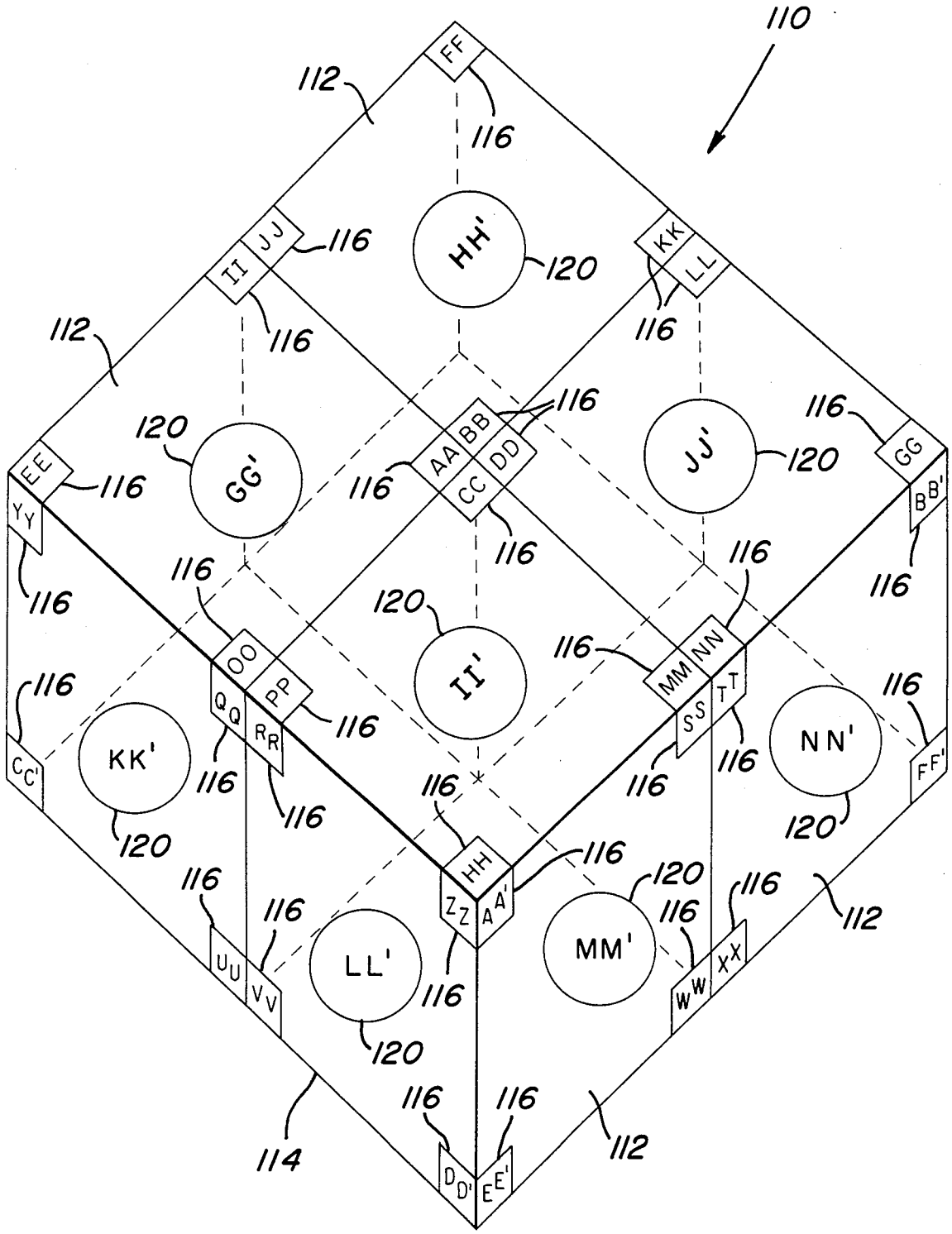
FIG. 2 is a perspective view of a second embodiment of the new and improved game or puzzle type amusement device constructed in accordance with the present invention and showing the cooperative parts thereof wherein the cube-shaped playing blocks or puzzle components are arranged in a two-by-two array so as to form an overall rectangular parallelepiped within which the cube-shaped playing or puzzle blocks are oriented with respect to each other, and the various faces thereof, so as to satisfy predetermined requirements, relationships, or the like, between the numbered dot indicia provided upon the cube-shaped blocks at the variously denoted locations thereof.

Referring now to FIG. 2 of the drawings, there is shown a second embodiment of the new and improved game or puzzle type amusement device of the present invention, as generally designated by the reference character 110. It is noted at this juncture that like or corresponding parts of this second embodiment of the present invention will be designated by similar reference characters as have been employed in connection with the respective component parts of the first embodiment of the present invention as depicted within FIG. 1 with the exception that the reference characters for the second embodiment will be within the 100 series. As can therefore be readily seen and appreciated, the new and improved game or puzzle type amusement device constructed in accordance with this second embodiment of the present invention is seen to comprise a set of four game-playing or puzzle blocks 112 each of which is in the shape of a cube. As was the case with the first embodiment, the four cube pieces or blocks are to be disposed within a two-by-two array, that is, two cubes wide by two cubes long, so as to, in effect, form a rectangular parallelepiped 114.

It is seen that each cube piece or block 112 is provided with various indicia upon each face or surface thereof there, of course, being six surfaces of each cube piece or block, and of course, still further, each cube face may be positioned or disposed in any one of six different planes so as to establish a particular relationship with an adjacent face of an adjacent cube piece or block 112. As was also the case with the first embodiment of the present invention, each indicia upon the faces of the cubes comprises a dot pattern of a number of dots, within the range from zero to nine, with the alphabetic letter designations being simply provided for ease of understanding and identification of the particular indicia locations with respect to the overall array within or upon the rectangular parallelepiped. More particularly, the numbered dot patterns are provided at each corner 116 of each face of each cube, as well as at a central region 120 of each cube face.

When the game is played, or the puzzle is to be resolved, according to particular rules, restrictions, requirements, or the like, as will be more fully set forth hereinafter, the four game or puzzle cubes pieces are set in position with respect to each other so as to form the aforenoted two-by-two array comprising the parallelepiped 114. It is of course to be appreciated that any one of the cube pieces or game components 112 may be oriented so as to have any one of its faces disposed within any one of the six planes, and in addition, any particular cube 112 may be placed within any one of the cube places within the overall array of the parallelepiped 114 in an attempt to win the game or solve the puzzle. When the cubes 112 are in fact disposed within their two-by-two array, it is seen that the central positions of indicia upon the upper horizontal surface of the parallelepiped 114 constitute the target numbers AABBCCDD, while the external corner locations upon the upper horizontal surface of the parallelepiped 114 constitute or designate the ring numbers EEFFGGHH. The locations of the indicia within the central peripheral edge portions upon the upper horizontal surface of the parallelepiped 114 designate the eight top proof numbers IIJJKKLLMMNNOOPP, while the eight numbered dot indicia located at the upper central regions of each of the four vertical rectangular size faces of the parallelepiped 114 are designated as the upper vertical proof numbers QQRRSSTT (the remaining four numbers not being shown). In a similar manner, the the eight numbered dot indicia located at the lower central regions of each of the four vertical rectangular side faces of the parallelepiped 114 are designated the lower vertical proof numbers UUVVWWXX (the remaining four numbers not being shown), while the eight numbered dot indicia located at the upper corners of each of the four vertical rectangular side faces of the parallelepiped 114 are designated the upper corner numbers YYZZAA'BB' (the remaining four numbers not being shown), and the eight numbered dot indicia located at the lower corners of each of the four vertical rectangular side faces of the parallelepiped 114 are designated as the lower corner numbers CC'DD'EE'FF' (the remaining four numbers not being shown). Lastly, the twenty-four numbered dot indicia located within the central region of each face of each cube 112 are designated the circle numbers GG'HH'II'JJ'KK'LL'MM'NN' (the remaining sixteen numbers not being shown).

In accordance with predetermined selective modes of playing the game or solving the puzzle comprising this second embodiment of the present invention, the cubes 112 may be arranged within a particular array such that the sum of the circle numbers upon each of the four vertical sides of the parallelepiped 114 adds up to a particular amount, such as, for example, seven, while at the same time, the sum of the four circle numbers upon the upper horizontal surface of the parallelepiped 114 adds up to another specific number, such as, for example, eleven. This is known as the seven-eleven game or puzzle.

A matching type game may also be established by requiring that the cubes 112 be arranged such that the two circle numbers upon each of the four vertical side faces of the parallelepiped 114 match each other, while at the same time, all of the circle numbers upon the upper horizontal surface of the parallelepiped 114 likewise match each other. In a variation of the aforenoted matching game or puzzle, a mis-matching game or puzzle can be established wherein the two circle numbers upon each of the four vertical side faces of the parallelepiped do not match each other, and the four circle numbers disposed upon the upper horizontal surface of the parallelepiped 114 also do not match each other.

As was the case with the two-dimensional first embodiment of the present invention, a proof of solution is likewise provided for in connection with this three-dimensional second embodiment of the present invention to the effect that when any one of the three aforenoted exemplary types of games or puzzles has been played or resolved, the sums of the paired top proof numbers will all be equal to each other, that is, II+JJ=KK+LL=MM+NN=00+PP while the sums of the paired upper vertical proof numbers and the sums of the paired lower vertical proof numbers are likewise equal to each other. Alternatively, another type of proof of solution might be that each top proof number of a paired set of top proof numbers is equal to its paired number, that is, II=JJ, KK=LL, MM=NN, and 00=PP while at the same time, each of the upper vertical proof numbers of a pair of upper vertical proof numbers is equal to its paired upper vertical proof number, that is, QQ=RR, SS=TT, and the like, and similarly, each of the lower vertical proof numbers of a pair of lower vertical proof numbers is equal to its paired lower vertical proof number, that is, UU=VV, WW=XX, and the like.

Obviously, many modifications and variations of the present invention are possible in light of the above teachings. For example, while the invention embodiments have been described with respect to numbered indicia at the various locations upon the game or puzzle cards or cubes, it is readily apparent that other types of indicia, such as, for example, colors, geometrical shapes, letters, or the like, can be utilized in lieu of numbered dot patterns. Still further, while a matching or mismatching type game or puzzle was only specifically described in connection with the three-dimensional embodiment of FIG. 2, a similar type game or puzzle can likewise be played in connection with the two-dimensional embodiment of FIG. 1 wherein, for example, matching or mismatching occurs between the outside target line numbers, the target numbers, or the inside target line numbers, as desired. It is therefore to be understood that within the scope of the appended claims, the present invention may be practiced otherwise than as specifically described herein.

I claim:

1. A game or puzzle, comprising at least four, two-dimensional card game pieces, wherein each one of said two-dimensional card game pieces has the configuration of a square, interchangeably disposable at predetermined locations with respect to each other, and orientable in any one of a plurality of different orientations at each one of said predetermined locations, so as to form at least an interrelated two-by-two array of said card game pieces which also has the configuration of a square;

dissimilar indicia disposed at each corner of each of said square-shaped card game pieces, as well as about the peripheral edge portions of each of said square-shaped card game pieces substantially centrally between said corners of each of said square-shaped card game pieces, so as to define a pattern of indicia upon each one of said card game pieces which is identical upon each one of said card game pieces whereby said orientations and interchangeability of said card game pieces is facilitated;

a first set of said indicia upon all of said card game pieces located at the center of said two-by-two array of said card game pieces as defined by the mating corners of each of said at least four square-shaped card game pieces;

a second set of said indicia upon all of said card game pieces located at the center of each peripheral edge portion of said two-by-two array of said card game pieces as defined by adjacent mating corners of adjacent pairs of said square-shaped card game pieces; and a third set of said indicia upon all of said card game pieces located between said first and second sets of said indicia along the mating edges of said adjacent pairs of said card game pieces as defined by said indicia located at said central peripheral edge portions of each one of said square-shaped card game pieces, said first, second, and third sets of indicia being related to each other when said card game pieces are disposed at correct ones of said locations, and in correct ones of said orientations, within said two-by-two array of said card game pieces so as to satisfy at least one of the relationships wherein: (I) all of said indicia of at least one of said second and third sets of said indicia is the same as or equal to all of said indicia of the same set of indicia of said second and third sets of indicia disposed respectively along each of said mating edges of said adjacent pairs of said card game pieces, or (2) all of said indicia of one of said second and third sets of indicia is the same as or equal to all of said indicia of the other one of said second and third sets of indicia disposed respectively along each of said mating edges of said adjacent pairs of said card game pieces, or (3) at least one of said entire sets of indicia is the same as or equal to at least one other one of said entire sets of indicia.

2. A game or puzzle, comprising:

at least four, three-dimensional game pieces, wherein each one of said three-dimensional game pieces has the configuration of a cube, interchangeably disposable at predetermined locations with respect to each other, and orientable in any one of a plurality of different orientations at each one of said predetermined locations, so as to form at least an interrelated two-by-two-by-one array of said cubical game pieces which has the configuration of a prallelepiped as defined by upper and lower horizontal planar surfaces which are at least two cube game pieces wide and two cube game pieces long, and vertical side planar surfaces which are one cube game piece deep;

dissimilar indicia disposed at each corner of each planar surface of each one of said cubical game pieces, as well as at the center of each of said planar surfaces of said each one of said cubical game pieces, so as to define a pattern of indicia upon said each one of said planar surfaces which is identical upon each one of said planar surfaces of said cubical gate pieces whereby said orientations and interchangeability of said cubical game pieces is facilitated;

a first set of said indicia upon all of said planar surfaces of all of said cubical game pieces located at the center of each one of said planar surfaces of said each one of said cubical game pieces;

a second set of said indicia upon all of said planar surfaces of all of said cubical game pieces located at the center of each peripheral edge portion of said upper and lower horizontal planar surfaces of said array of said cubical game pieces as defined by adjacent mating corners of adjacent mating pairs of said cubical game pieces;

a third set of said indicia upon all of said planar surfaces of all of said cubical game pieces located at the center of each upper edge portion of each vertical side planar surface of said array of said cubical game pieces as defined by adjacent mating corners of adjacent mating pairs of said cubical game pieces; and a fourth set of said indicia upon all of said planar surfaces of all of said cubical game pieces located at the center of each lower edge portion of each vertical side planar surface of said array of cubical game pieces as defined by adjacent mating corners of adjacent mating pairs of said cubical game pieces, said first, second, third, and fourth sets of said indicia being related to each other when said cubical game pieces are disposed at correct ones of said locations, and in correct ones of said orientations, within said two-by-two-by-one array of said cubical game pieces so as to satisfy at least one of the relationships wherein: (1) all of said indicia of said first set of said indicia, and located upon any one vertical side planar surface of said array of cubical game pieces, is the same as or equal to all of said indicia of said first set of said indicia located upon all of the remaining vertical side planar surfaces of said array of cubical game pieces, or (2) the indicia of said first set of said indicia, and located upon each planar surface of each of said cubical game pieces disposed within each of said vertical side planar surfaces of said array of cubical game pieces, is the same as or equal to the indicia of said first set of said indicia located upon the same vertical side planar surface of said array of cubical game pieces, or (3) all of the indicia of any one of said second, and third and fourth, sets of indicia, respectively located at any one of said edge locations upon said upper and lower horizontal planar surfaces, and said vertical side surfaces, of said array of cubical game pieces, is the same as or equal to all of the indicia of the same set of indicia located at the remaining ones of said edge locations upon said upper and lower horizontal planar surfaces, and said vertical side surfaces, of said array of said cubical game pieces, or (4) the indicia of any one of said second, and third and fourth, sets of indicia, respectively located at any one of said edge locations upon said upper and lower horizontal planar surfaces, and said verticle side surfaces, of said array of said cubical game pieces, is the same mas or equal to the indicia of the same set of indicia located at the same edge location, as defined by the adjacent indicia of adjacent mating corners of adjacent mating pairs of said cubical game pieces, while the remaining indicia of said other ones of said second, and third and fourth, sets of indicia, respectively located at the remaining ones of said edge locations upon said upper and lower horizontal planar surfaces, and said vertical side planar surfaces, of said array of said cubical game pieces, are the same as or equal to the indicia of the same sets of indicia, respectively located at the same edge locations corresponding to said remaining indicia respectively located at said remaining ones of said edge locations upon said upper and lower horizontal planar surfaces, and said vertical side planar surfaces, of said array of cubical game pieces.

3. A game or puzzle as set forth in claim 1, wherein:
said indicia is one type selected from the group of numbers, colors, letlters, or geometrical shapes.

4. A game or puzzle as set forth in claim 3, wherein:
said indicia comprise numbers; and
each indicia of said second set, when added to a respective indicia of said third set disposed along the same mating edge as said indicia of said second set, is equal to the sum of respective indicia of said second and third sets along their respective mating edges.

5. A game or puzzle as set forth in claim 3, wherein:
said indicia comprise numbers; and
each indicia of said second or third set, as disposed along each of said mating edges, is equal to said indicia of said first set.

6. A game or puzzle as set forth in claim 3, wherein:
said indicia comprise numbers; and
the sum of each indicia of said second set, when added to a corresponding indicia of said third set, as considered along said mating edges, is equal to the sum of the indicia of said first set.

7. A game or puzzle as set forth in claim 3, wherein:
said indicia comprise numbers; and
the sum of each indicia of said second set, when added to the sum of the indicia of said first set, is equal to the sum of the indicia of said third set, respectively along each of said mating edges.

8. A game or puzzle as set forth in claim 1, wherein:
each of said two-dimensional card game pieces has a first surface on one side of said card game piece, and a second surface on the opposite side of said card game piece; and
said indicia is disposed upon both of said sides of said card game pieces.

9. A game or puzzle as set forth in claim 8, wherein:
said indicia upon both of said sides of said card game pieces must satisfy one of said predetermined requirements of said game or puzzle so as to define the end of said game or the solution to said puzzle.

10. A game or puzzle as set forth in claim 2, wherein:
said indicia is one type selected from the group of numbers, colors, letters, or geometrical shapes.

11. A game or puzzle as set forth in claim 10, wherein:
said indicia comprise numbers; and
said indicia of said first set disposed upon each of said vertical side planar surfaces has a sum equal to a predetermined number.

12. A game or puzzle as set forth in claim 10, wherein:
said indicia comprise numbers; and
said indicia of said first set disposed upon each of said upper and lower horizontal planar surfaces has a sum equal to a predetermined number.

13. A game or puzzle as set forth in claim 11, wherein:
said indicia of said first set disposed upon each of said upper and lower horizontal planar surfaces has a sum equal to a predetermined number which is different than said predetermined number of said indicia of said first set disposed upon each of said vertical side planar surfaces.

14. A game or puzzle as set forth in claim 10, wherein:
said indicia comprise numbers; and
said indicia of said first set disposed upon each of said cubical game pieces and within said upper and lower horizontal planar surfaces are equal to each other.

* * * * *